US011306906B1

(12) United States Patent
Blauer et al.

(10) Patent No.: US 11,306,906 B1
(45) Date of Patent: Apr. 19, 2022

(54) HAND MOUNTED LIGHT

(71) Applicant: Blauer Manufacturing Company, Inc., Boston, MA (US)

(72) Inventors: Stephen J Blauer, Lexington, MA (US); James H Sadler, Huntington, VT (US)

(73) Assignee: Blauer Manufacturing Company, Inc., Boston, MA (US)

( * ) Notice: Subject to any disclaimer, the term of this patent is extended or adjusted under 35 U.S.C. 154(b) by 0 days.

(21) Appl. No.: 17/444,056

(22) Filed: Jul. 30, 2021

Related U.S. Application Data

(60) Provisional application No. 62/706,068, filed on Jul. 30, 2020.

(51) Int. Cl.

| | |
|---|---|
| ***F21V 21/40*** | (2006.01) |
| ***F21V 21/08*** | (2006.01) |
| ***F21L 4/00*** | (2006.01) |
| ***F21V 23/04*** | (2006.01) |
| ***F21V 21/088*** | (2006.01) |
| ***F21Y 115/10*** | (2016.01) |

(52) U.S. Cl.
CPC ..... *F21V 21/406* (2013.01); *F21L 4/00* (2013.01); *F21V 21/0816* (2013.01); *F21V 21/0885* (2013.01); *F21V 23/04* (2013.01); *F21Y 2115/10* (2016.08)

(58) Field of Classification Search
CPC ..... F21V 21/406; F21V 21/0816; F21V 21/0885; F21L 4/02; F21L 4/027
USPC ..... 362/190, 191
See application file for complete search history.

(56) References Cited

U.S. PATENT DOCUMENTS

| | | | | |
|---|---|---|---|---|
| 5,345,368 | A | 9/1994 | Huff | |
| 7,070,295 | B1 * | 7/2006 | Lee | B62J 6/03 362/191 |
| 7,520,629 | B2 | 4/2009 | Johnson et al. | |
| 8,303,129 | B1 | 11/2012 | Thielen | |
| 8,562,170 | B2 * | 10/2013 | Sohn | F21L 4/04 362/191 |
| 10,344,924 | B1 | 7/2019 | Ganahl | |
| 2006/0007669 | A1 | 1/2006 | Blackburn | |
| 2006/0109646 | A1 | 5/2006 | Bruno | |
| 2010/0139048 | A1 | 6/2010 | Pesic | |
| 2011/0063826 | A1 * | 3/2011 | Lau | F21L 4/027 362/190 |

(Continued)

FOREIGN PATENT DOCUMENTS

| | | | |
|---|---|---|---|
| WO | 2014027168 | A1 | 2/2014 |

*Primary Examiner* — Lau K Tso
(74) *Attorney, Agent, or Firm* — Altman & Martin; Steven K Martin

(57) ABSTRACT

A light that mounts to the back of the hand by a band. A housing has a narrow beam lamp and the wide beam lamp with a corresponding lens system to form a light beam with the desired divergence. A number of power control configurations are contemplated, including separate on/off switches, multi-position switches, luminosity level switches with a master on/off switch, and a single switch for each lamp that cycles through several luminosity levels. Power is supplied by batteries. The band includes a bracket attached to the housing and a strap that permanently or removably attaches to the bracket, the combination of which encircles the hand. The light includes mechanisms for adjusting the housing relative to the band.

22 Claims, 13 Drawing Sheets

(56) References Cited

U.S. PATENT DOCUMENTS

| | | | | |
|---|---|---|---|---|
| 2012/0081884 | A1 | 4/2012 | Gonzalez | |
| 2013/0194784 | A1* | 8/2013 | Yu | F21V 21/145 362/108 |

* cited by examiner

HAND MOUNTED LIGHT

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to public safety, more particularly, to devices for illuminating a scene being investigated.

2. Description of the Related Art

There are currently several methods of providing light when holding a handgun. In one, a standard flashlight is held in the hand in one of a number of different techniques. All of the techniques are relatively awkward and unstable, particularly since both hands should be used to stabilize the weapon.

In another, a pistol mounted light is typically designed to be mounted to the underside of the barrel. They cause problems with the operation of some handguns, they add weight to the weapon, and most holsters are not designed to accommodate them.

BRIEF SUMMARY OF THE INVENTION

The present invention is a light that mounts to the back of the hand. The basic components are a housing, narrow beam lamp, wide beam lamp, band, power control, and power source. The housing is composed of a high-impact, lightweight, rigid material. Optionally, the housing is watertight.

On the front are two openings for the narrow beam lamp and the wide beam lamp. Each lamp has one or more light-emitting diodes that emits light into a corresponding lens system chosen to form a beam with the desired divergence. In one configuration, the beam divergence is fixed. In another configuration, the beam divergence is adjustable.

A number of power control configurations contemplated. In one, each lamp has a fixed luminosity and an on/off switch. In another, each lamp has several levels of luminosity and a multi-position switch. More complicated configurations include a controller that takes as input the power source and various switches and drives the lamps. In one configuration, the luminosity of each lamp is preset by a switch associated with each lamp and a master switch implements the presets. In another configuration, there is a single switch for each lamp that cycles through the settings for its associated lamp. Optionally, there are duplicate sets of switches providing the same functions, one set on the top and one on the bottom to allow for right-handed and left-handed operation.

Power is supplied by a power source that includes internal batteries. The batteries can be rechargeable, and the appropriate recharging power is supplied through a socket. Alternatively, the batteries are replaceable through a hatch. An optional battery level indicator.

The light is mounted to the back of the hand by the band, which includes a bracket and a strap that combine to encircle the hand. The bracket is an elongated strip of lightweight material attached to the inside of the housing. The bracket is attached by whatever means is appropriate and can be permanent or removable. In one configuration, the bracket is attached by one or more screws. One screw allows the bracket to be rotated to orient the light vertically as desired. More than one screw can be used to prevent the bracket from rotating.

The light optionally includes one or more mechanisms for adjusting the light relative to the back of the hand. In one mechanism, the screw hole in the bracket is a slot so that, when the screw is loosened, it can be moved within the slot to adjust the position of the light. In another mechanism, a spacer can be installed on the screw to adjust the distance between the housing and the back of the hand. In another mechanism, a wedge-shaped spacer can be installed on the screw to adjust the angle between the light and the hand. A more flexible mechanism is a ball joint attaching the bracket to the housing. The ball joint permits adjustment over three dimensions.

The ends of the bracket have lateral strap slots to hold the strap. The strap is a strip of flexible material. Optionally, the strap is elastic. The strap can be permanently attached by threading the end of the strap through the strap slot, folding it over, and sewing the overlapping sections together. Alternatively, a ladder lock larger than the slot can be used. The strap can be removably attached by using a ladder lock shorter than the strap slot or a toggle that is longer than the strap slot.

The light can be mounted to a duty belt or vest by any practical means.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
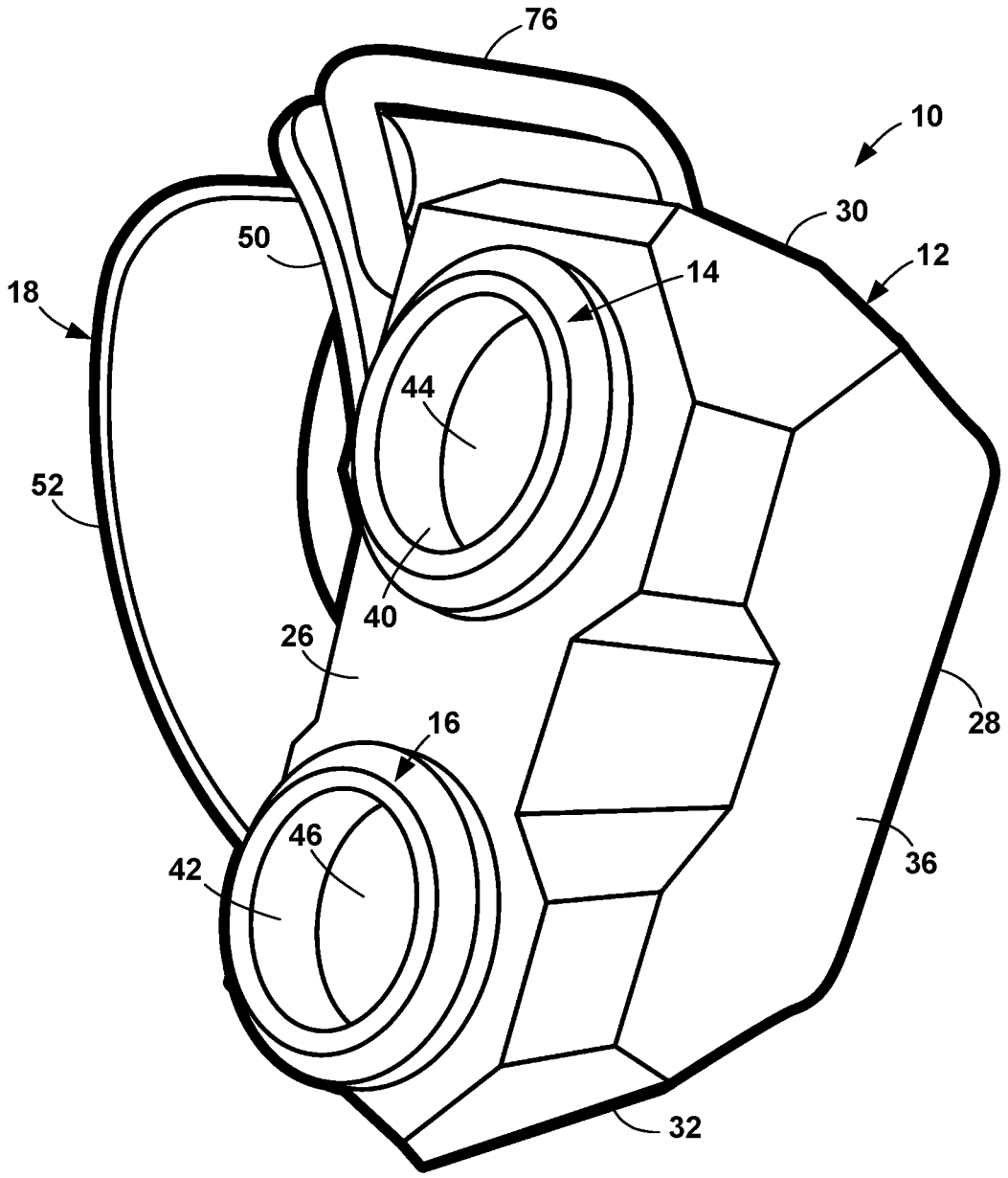
FIG. 1 is a front outside perspective view of the light of the present invention.
Figure 2:
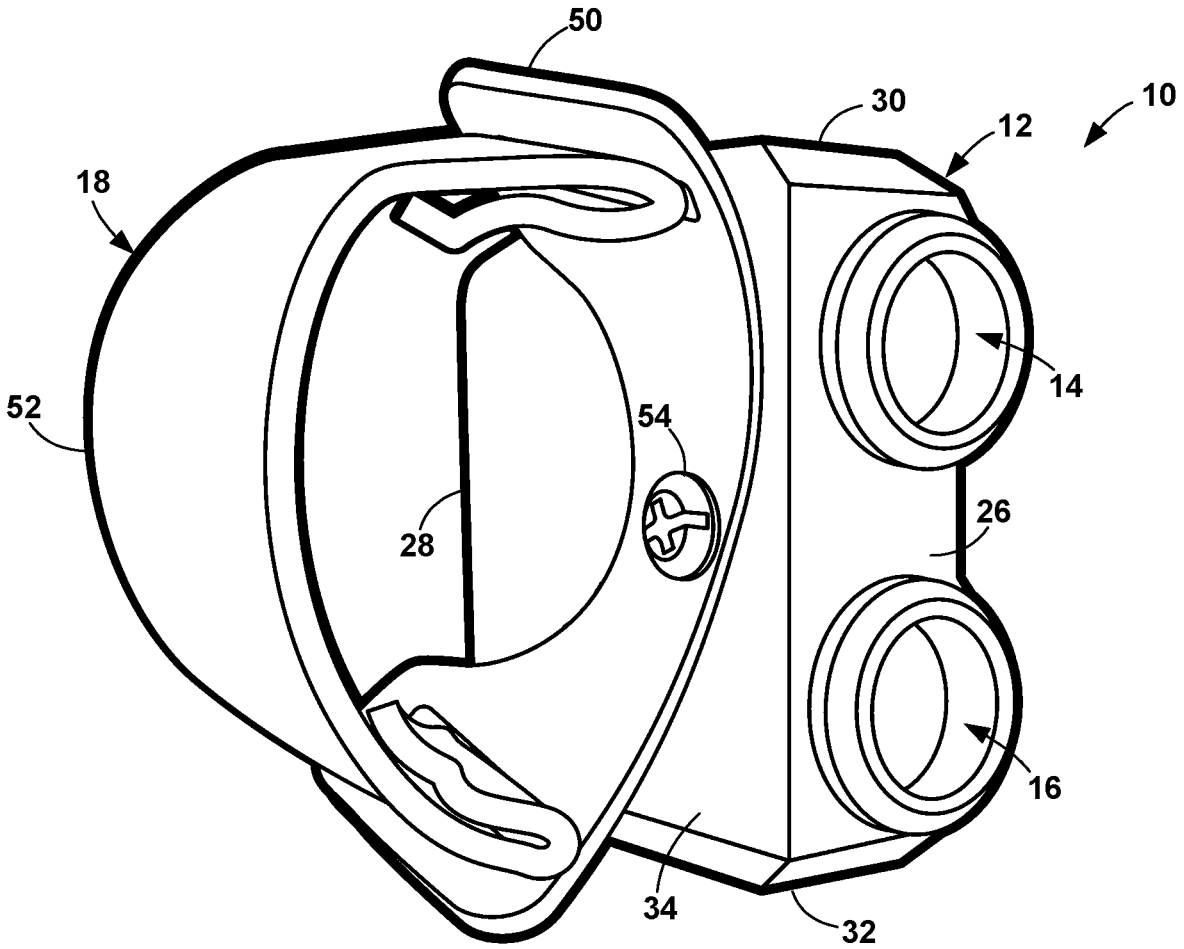
FIG. 2 is a front inside perspective view.
Figure 3:
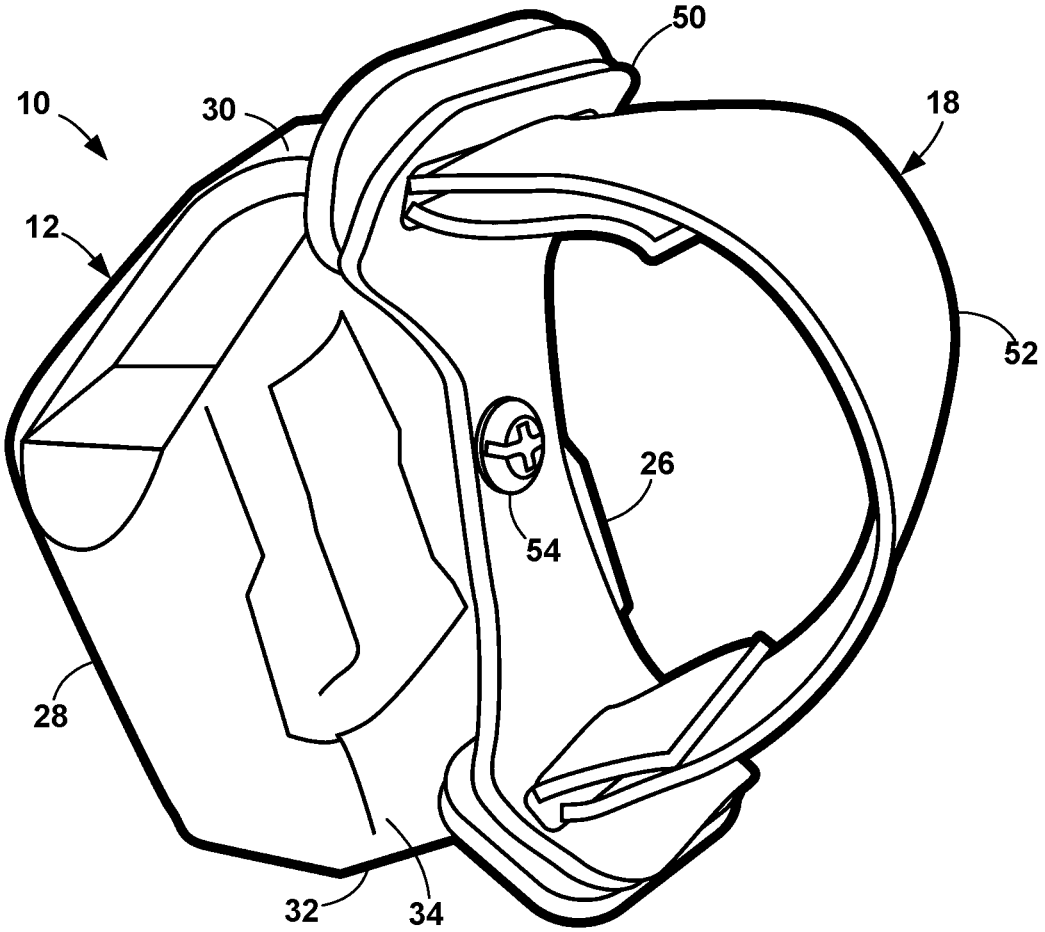
FIG. 3 is a back inside perspective view.
Figure 4:
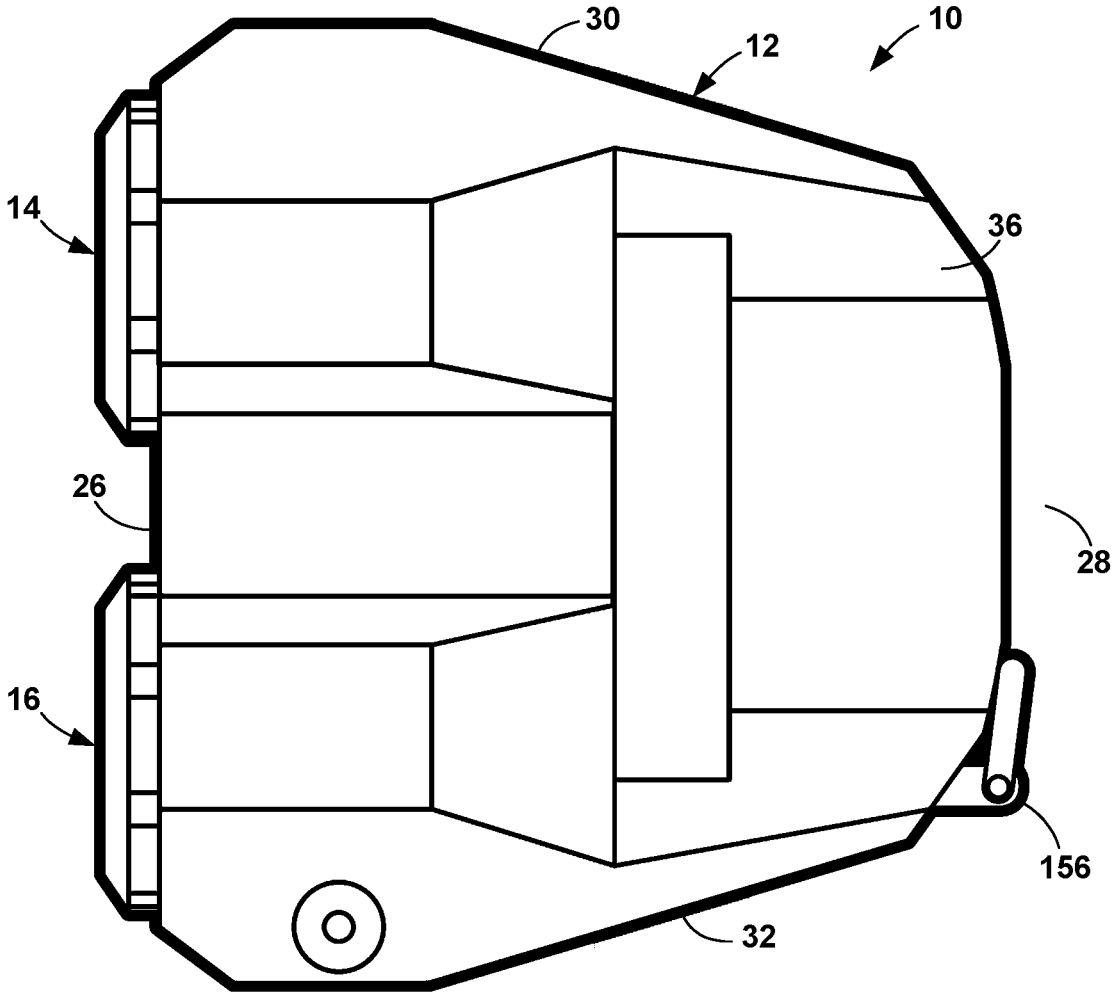
FIG. 4 is an outside plan view.
Figure 5:
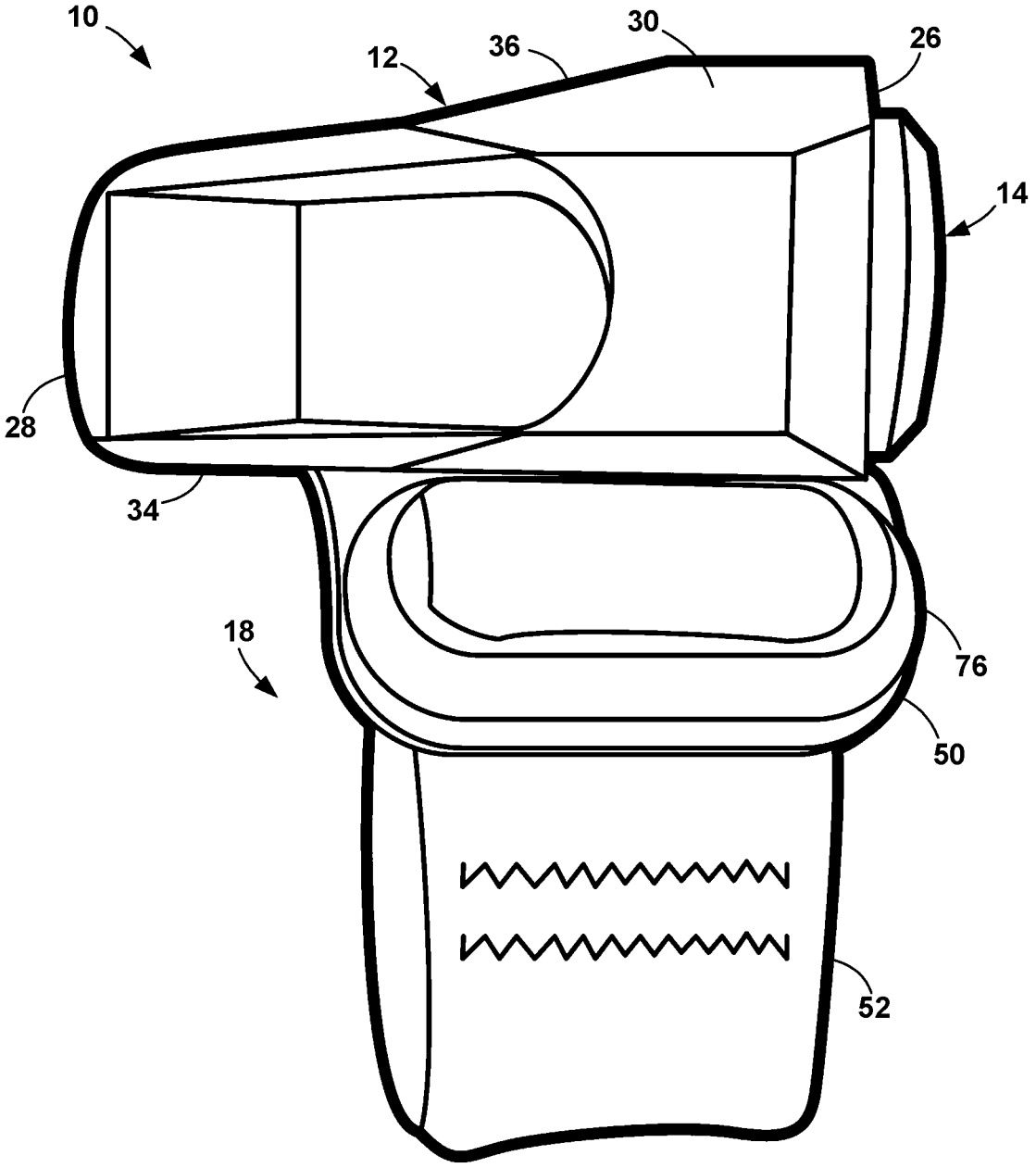
FIG. 5 is a top plan view.

The present application hereby incorporates by reference in its entirety U.S. Provisional Patent Application No. 62/706,068, on which this application is based.

The present invention is a light 10 that mounts to the back of the hand 2, so as to free the hand 2 for other duties. The basic components of the light are a housing 12, a narrow beam lamp 14, a wide beam lamp 16, a band 18, power control 20, and a power source 22. The light 10 of the present invention is designed to be as unobtrusive as practical so that, when worn, it has minimal effect on the user while providing the desired functionality.

Figure 6:
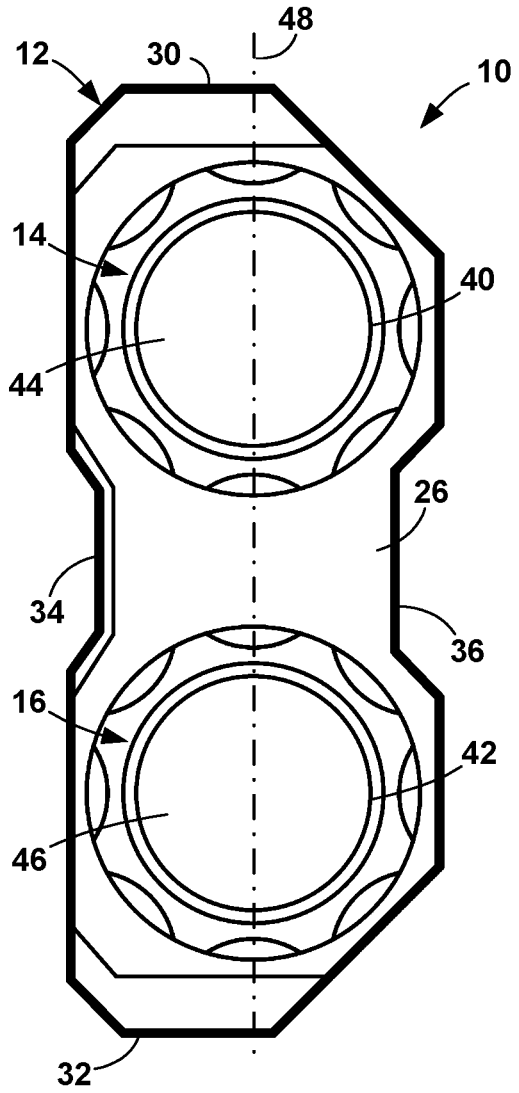
FIG. 6 is a front plan view of the housing.
Figure 15:
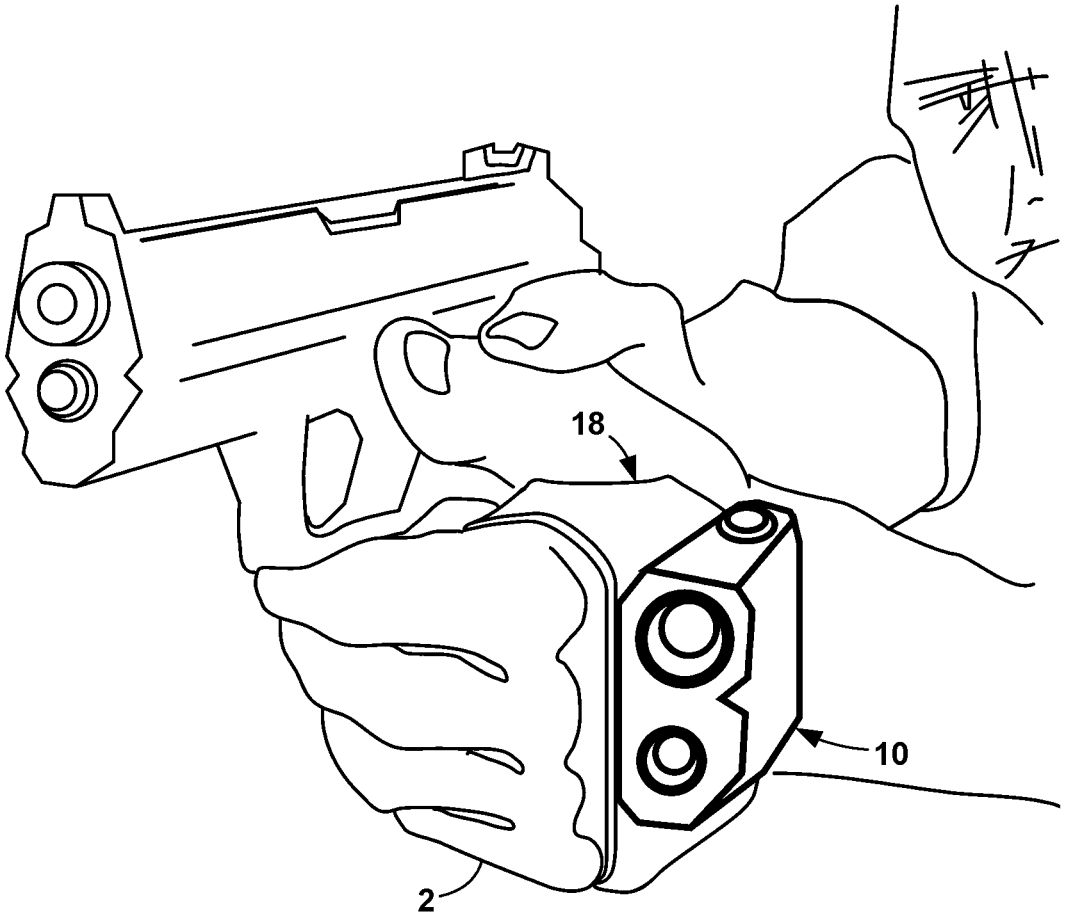
FIG. 15 is a perspective view of the light in use.

When the light 10 is in use on the left hand, it is typically oriented as shown in FIGS. 6 and 15. Each face has a designation. The face from where the light emits is the front 26 and the opposite face is the back 28. The upper face is the top 30 and the opposite face is the bottom 32. The top 30 and bottom 32 are reversed if the user wears the light 10 on the right hand. The face toward the hand 2 is the inside 34 and the opposite face is the outside 36.

The housing 12 is composed of a high-impact, lightweight, rigid material, such as a plastic, composite, or aluminum alloy. The size and shape of the housing 12 is determined, in part, by the size of the power source 20, described below. Optionally, the housing 12 is watertight.

On the front 26 of the housing 12 are two openings 40, 42, one for the narrow beam lamp 14 and the other for the wide beam lamp 16. The line of alignment 48 of the lamps 14, 16 is generally parallel to the inside 34. Each lamp 14, 16 has one or more light-emitting diodes (LEDs) as a light source that emits light into a corresponding lens system 44, 46. The lenses of each lens system 44, 46 are chosen by methods well-known in the art to form a beam with the desired divergence, the angle at which the beam spreads out from the lamp opening 40, 42. For the narrow beam, the divergence is in the range of from 5° to 30°. For the wide beam, the divergence is in the range of from 45° to 100°.

In one configuration, the beam divergence is fixed, that is, each lens system 44, 46 is fixed to form a beam divergence that cannot be adjusted. In another configuration, the beam divergence is adjustable. Typically, one lens of a compound lens is mounted in a rotating bezel that is manually rotated to adjust the divergence. The bezel can include detents so that the bezel does not rotate unintentionally.

Figure 7:
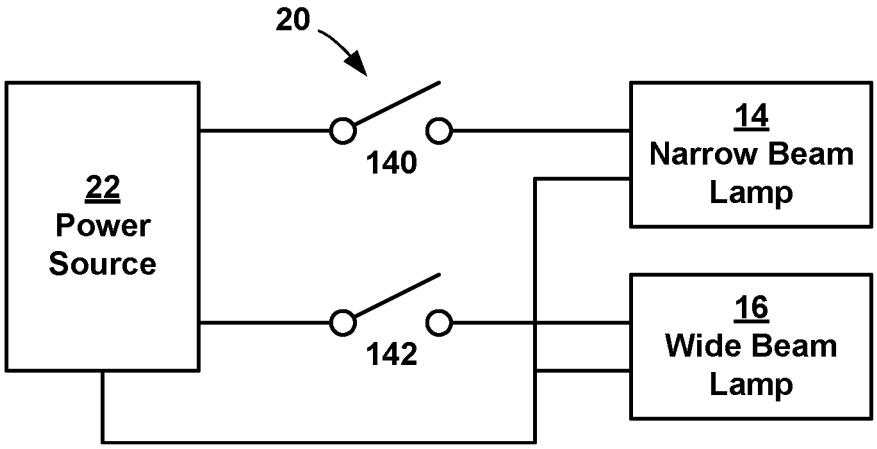
FIG. 7 is a block diagram of a light control.

The power control 20 controls the luminosity of the lamps 14, 16 and can take a number of different forms. One configuration of the power control 20 is shown in FIG. 7. In this configuration, each lamp 14, 16 has a fixed luminosity. Preferably, the fixed luminosity is at least 500 lumens for the narrow beam, and at least 200 lumens for the wide beam. An on/off switch 140, 142 for each lamp 14, 16 merely feeds power from the power source 22 to the corresponding lamp 14, 16. The switches 140, 142 can be located on the top 30 and/or bottom 32 to allow for right-handed and left-handed operation.

In a more versatile configuration of the power control 20, the luminosity of each lamp 14, 16 is fixed at one of several levels. A multi-position switch for each lamp 14, 16 merely feeds the right amount of power from the power source 22 to the corresponding lamp 14, 16, where there is an off position and two or more on positions. One position will typically be full luminosity and other position(s) will attenuate luminosity by some amount by, for example, ⅓ and ⅔. The switches can be located on the top 30 and/or bottom 32 to allow for right-handed and left-handed operation.

More complicated configurations typically include an electronic controller 24, located within the housing 12, to control the operation of the light 10. The controller 24 takes as input the power source 22 and various controls, discussed below, and drives the lamps 14, 16. The configurations described above can be implemented with a controller 20.

Figure 8:
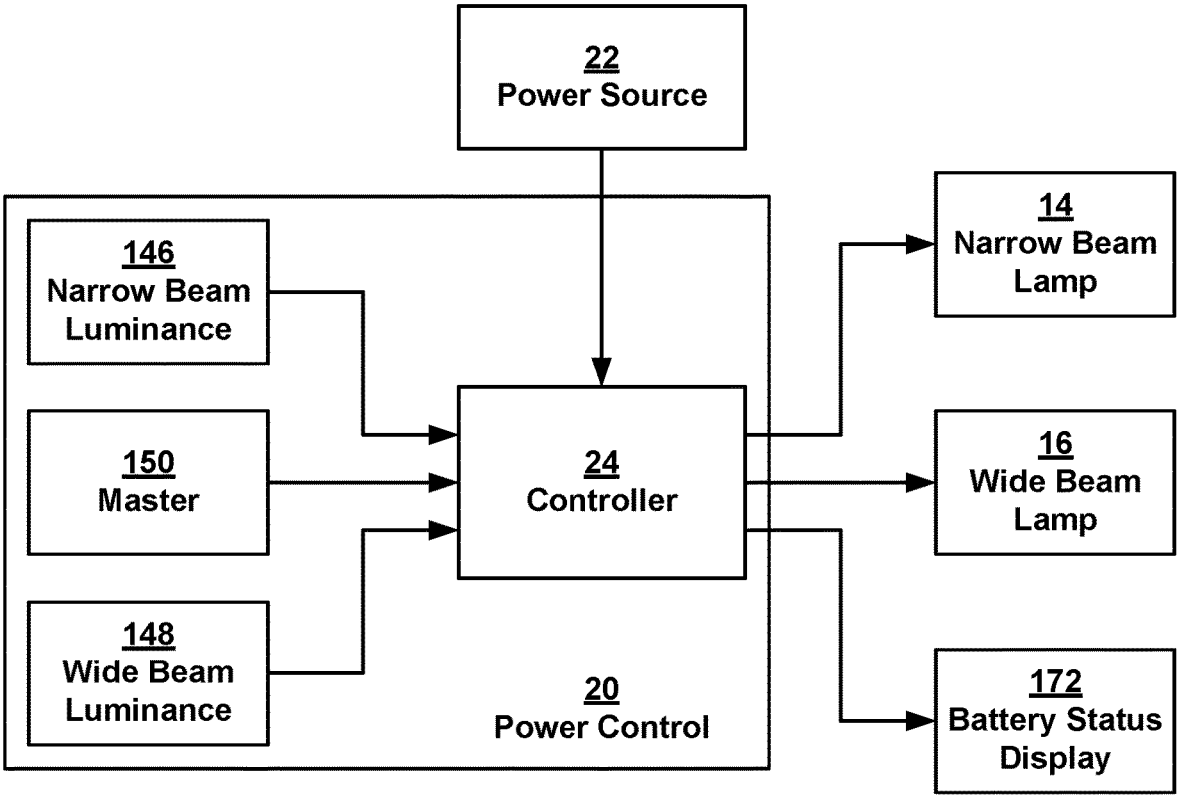
FIG. 8 is a block diagram of a basic control system.
Figure 9:
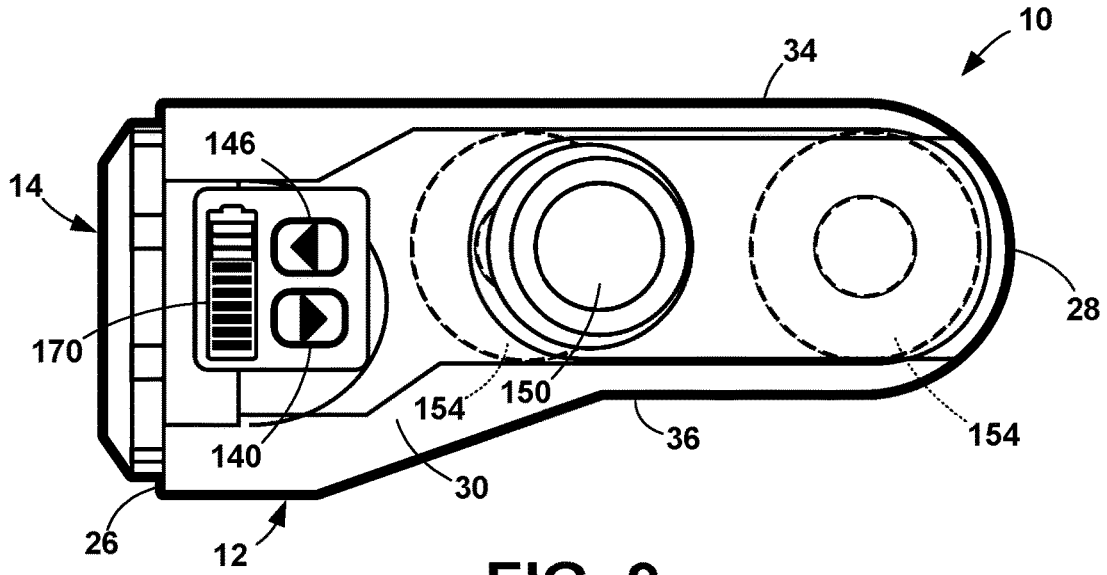
FIG. 9 is a top partial phantom plan view of the housing.
Figure 10:
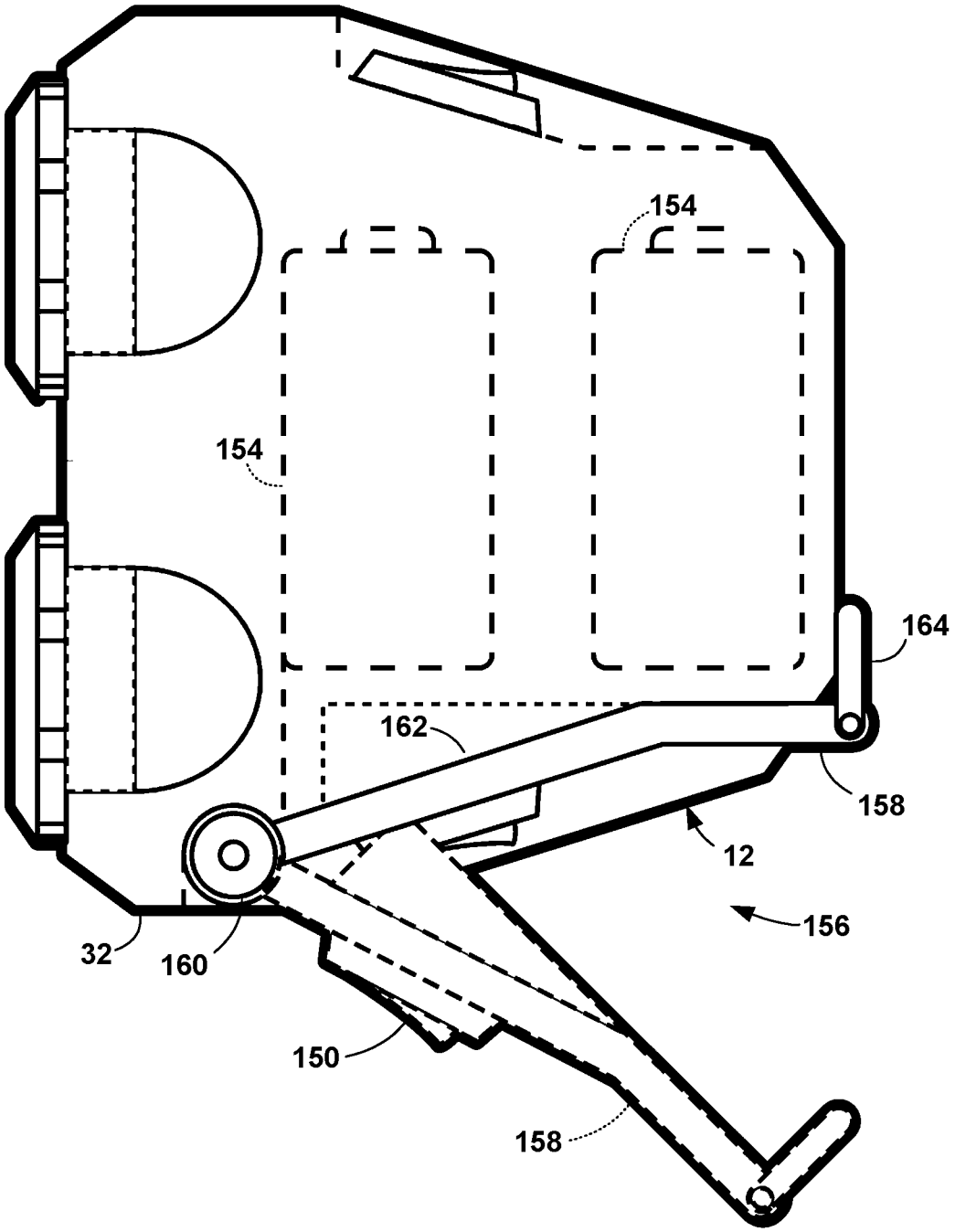
FIG. 10 is an outside partial phantom plan view.

In one configuration, shown in FIGS. 8 and 9, the luminosity of each lamp 14, 16 is preset by a switch 146, 148 associated with each lamp 14, 16 and a master switch 150 implements the presets. More specifically, pushbuttons cycle through each of the luminosity levels of the lamps 14, 16 without turning them on. For example, the narrow beam lamp switch 146 cycles through high-low-strobe-off and the wide beam lamp switch 148 cycles through high-low-off. The lamp pushbuttons 146, 148 are on a panel on the top and/or bottom of the housing 12. Optionally, an indicator shows the setting for each of the lamps 14, 16. A master switch 150 on the top 30 and/or bottom 32 of the housing 12 applies power to the lamps 14, 16 using the pushbutton settings. The master switch 150 can be a pushbutton or a toggle switch.

In another configuration, there is a single switch for each lamp 14, 16 that provides all the control for its associated lamp 14, 16. Each switch cycles through the settings for its associated lamp 14, 16. Optionally, there are duplicate sets of switches providing the same functions, one set on the top 30 and one on the bottom 32 to allow for right-handed and left-handed operation.

Preferably, the color temperature of the lamps 14, 16 is at least 4000 K so that they illuminate objects more sharply.

Power is supplied by a power source 22 that includes one or more internal batteries 154. In one configuration, the batteries 154 are rechargeable, and the appropriate recharging power is supplied through a socket. In the preferred configuration, the batteries 154 are replaceable through a hatch 156 in the bottom 32 of the housing 12. The replaceable batteries 154 can be rechargeable or not rechargeable. Replaceable batteries 154 permit the user to quickly replace them in the field.

Preferably, the batteries 154 provide at least two hours of operation at the highest usage level.

Optionally, a battery level indicator 170 shows the status of the battery 154. When the light 10 is off, indicator 170 can show the battery level. When the light 10 is on, the indicator 170 can show either the battery level or the approximate amount of time that the battery 154 can maintain the current usage level of the light.

Replaceable batteries 154 are installed and removed through the hatch 156. The hatch 156 has a door 158 that is hinged at one end, as at 160, to swing away from the battery opening 162. The other end of the door 158 has a latch 164 to secure the door 158 closed, thereby securely retaining the batteries 154 in the housing 12. Optionally, the hatch 156 includes a watertight seal around the perimeter.

The light 10 is mounted to the back of the hand 2 by the band 18, which includes a bracket 50 and a strap 52 that combine to encircle the hand 2. The bracket 50 is an elongated strip of lightweight material, such as a plastic or aluminum alloy, that is attached to the inside 34 of the housing 12. The bracket 50 is oriented such that it runs generally vertically across the housing inside 34. The bracket 50 is attached to the housing 12 by whatever means is appropriate and can be permanent or removable. In one configuration, the bracket 50 is attached by one or more screws 54 through holes 56 in the bracket 50 and into threaded holes 58 into the housing inside 34. If one screw 54 is used, as in FIG. 13, the bracket 50 can be rotated to adjust the lamps 14, 16 up and down relative to the back of the hand 2. Alternatively, if the bracket 50 is to be in a fixed position, optional features on the inside 34 prevent the bracket 50 from rotating relative to the housing 12. Alternatively, more than one screw 54 can be used to prevent the bracket 50 from rotating, as in FIG. 14.

Optionally, the screws 54 are countersunk or otherwise recessed to keep from rubbing on the back of the hand 2 while in use. Alternatively, the screws 54 are covered by a softer material to isolate the screws 54 from the back of the hand 2.

The light 10 optionally includes a mechanism for adjusting the location of the light 10 relative to the back of the hand 2. In an example of such a mechanism, the screw hole 56 in the bracket 50 is a slot, either vertical, horizontal, or both as a plus sign shape. When the screw 54 is loosened, it can be moved within the slot 56 to adjust the vertical or horizontal position of the light 10 on the hand 2.

The light 10 optionally includes a mechanism for adjusting the distance of the light 10 relative to the back of the hand 2. In an example of such a mechanism, a spacer can be installed on the screw 54 between the housing 12 and the bracket 50. The thickness of the spacer determines the distance between the housing 12 and the back of the hand 2.

The light 10 optionally includes a mechanism for adjusting the side-to-side angle of the light 10 relative to the back of the hand 2. In an example of such a mechanism, a wedge-shaped spacer can be installed on the screw 54 between the housing 12 and the bracket 50. When the thicker portion of the spacer is toward the front, the lamps 14, 16 are angled away from the back of the hand 2. When the thicker portion of the spacer is toward the back, the lamps 14, 16 are angled toward the back of the hand 2.

Figure 11:
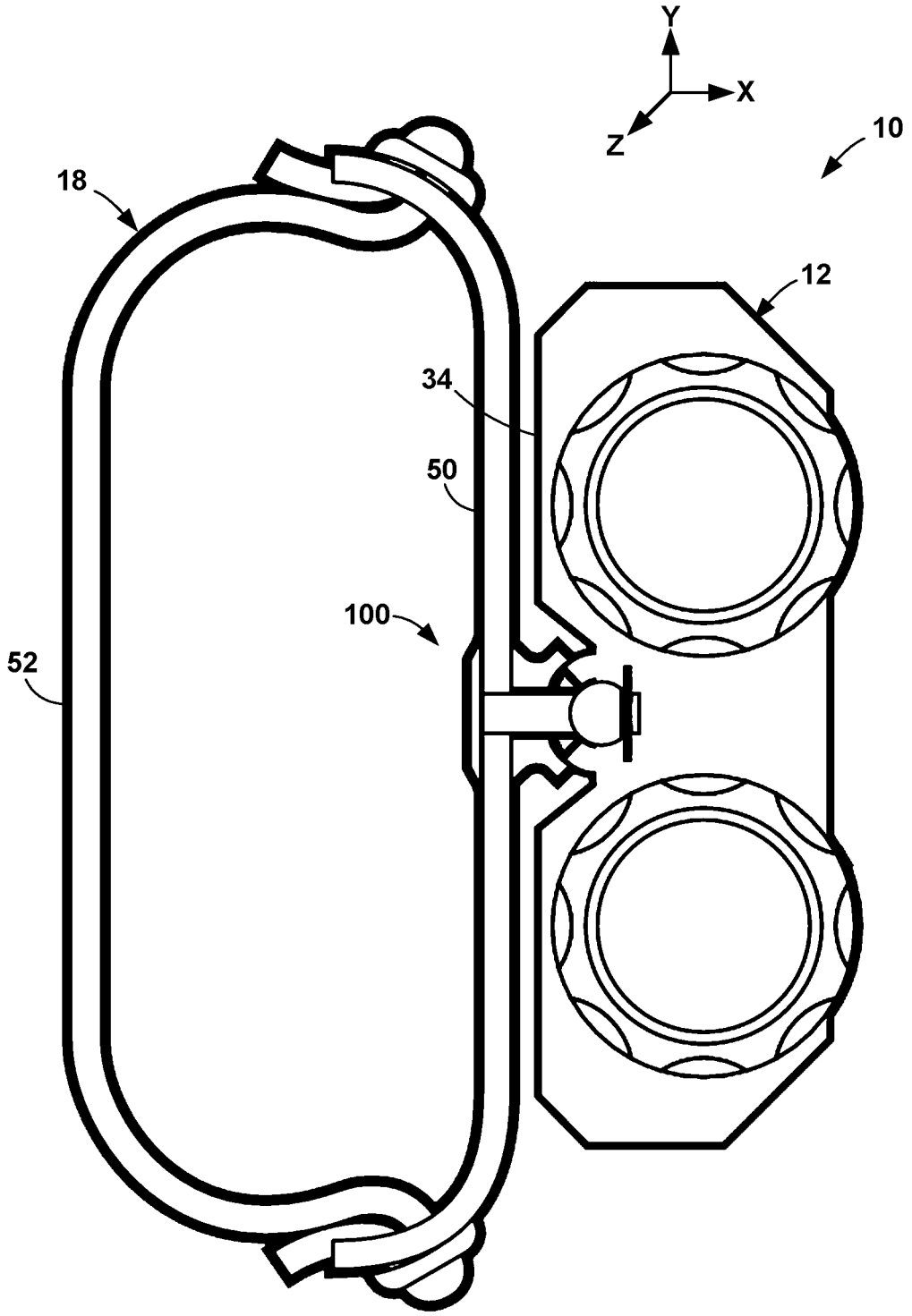
FIG. 11 is a front plan view of the light showing an adjustable attachment between the housing and bracket.
Figure 12:
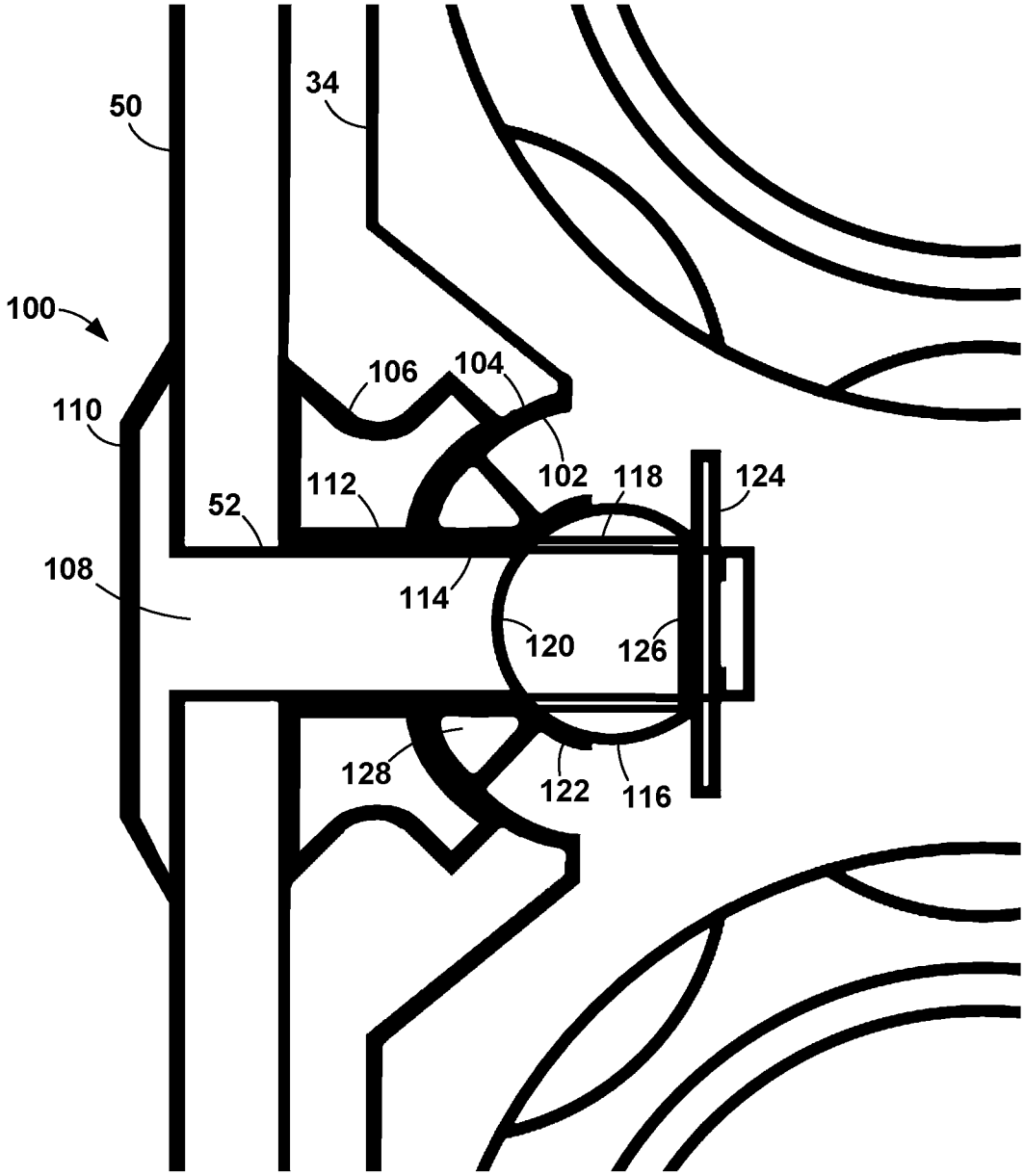
FIG. 12 is a detailed view of the adjustable attachment of FIG. 11.

A more flexible mechanism for adjusting the angle of the light 10 relative to the hand is a ball joint 100, shown in FIGS. 11 and 12. The ball joint 100 has a convex outer spherical bearing surface 102 on the inside 34 of the housing 12. A mating concave outer spherical bearing surface 104 is on a spacer 106 straddling the hole 52 in the bracket 50. A clevis pin 108 with a head 110 abutting the bracket 50 extends through the bracket hole 52 and a hole 112 in the spacer 106, though a hole 114 in the center of the outer convex spherical bearing surface 102, and through a hole 118 through the center of a truncated sphere 116. The surface of the sphere 116 is a convex inner spherical bearing surface 120 that abuts a concave inner spherical bearing surface 122 that is within and concentric with the concave outer spherical bearing surface 104. A C-clip 124 secures the clevis pin 108 with the C-clip 124 abutting the truncated surface 126 of the sphere 116. Alternatively, the truncated sphere hole 118 and the clevis pin 108 are threaded, and the clevis pin 108 is turned into the truncated sphere hole 118. In this configuration, the C-clip 124 is optional and the sphere 116 may or may not be truncated. The hole 114 in the center of the outer convex spherical bearing surface 102 is conical, as at 128.

The ball joint 100 includes a mechanism to retain the housing 12 in the desired position. In one configuration, the mechanism is merely a tight fit between components. In the case, the ball joint is hard to adjust, but stays where it is. In another configuration, a spring is installed on the clevis pin 108, for example, between the C-clip 124 and the truncated surface 126, that pulls the bearing surfaces together.

Referring to FIG. 11, the ball joint 100 permits adjustment over three dimensions in roll (XY plane, rotation on the Z axis), pitch (YZ plane, rotation on the X axis with the light beams moving up and down), and yaw (XZ plane, rotation on the Y axis with the light beams moving side to side). In roll, the angle of motion is limited by several factors, including the height of the light 10 and the thickness of the spacer 106. In the present design, the angle of motion is approximately ±2°. In pitch, without stops, there is no limit; it can spin a full 360° around the bracket 50. To limit motion, stops on either the bracket 50 or the inside 34 of the housing 12 can keep the light 10 pointing forward. Typically, the pitch will be limited in a range at least ±10° up to ±20°. In yaw, the angle of motion is limited by several factors, including the length of the light 10, the thickness of the spacer 106, and how it is mounted on the user's hand 2. Typically, the yaw will have a minimum range of at least ±2° and up to ±10°.

The bracket 50 extends beyond the sides of the housing 12. The ends of the bracket 50 are typically curved away from the housing 12, as at 70, so that it partially cups the back of the hand 2. Lateral strap slots 72 at the ends 74 of the bracket 50 hold the strap 52.

The strap 52 is a strip of flexible material, such as a nylon, polyester, or polypropylene webbing. Optionally, the strap 52 is elastic. The strap 52 is attached to the bracket 50 by the strap slots 72. The strap 52 can be permanently or removably attached. A permanent attachment can be threading the end of the strap 52 through the strap slot 72, folding it over, and sewing the overlapping sections together.

Another permanent attachment can be inserting the end of the strap 52 through the strap slot 72, and then looping the end of the strap 52 around the center bar of a ladder lock and sewing the overlapping sections together. The ladder lock is longer than the strap slot 72 and so cannot fit through the strap slot 72, thereby retaining the strap 52.

Figure 13:
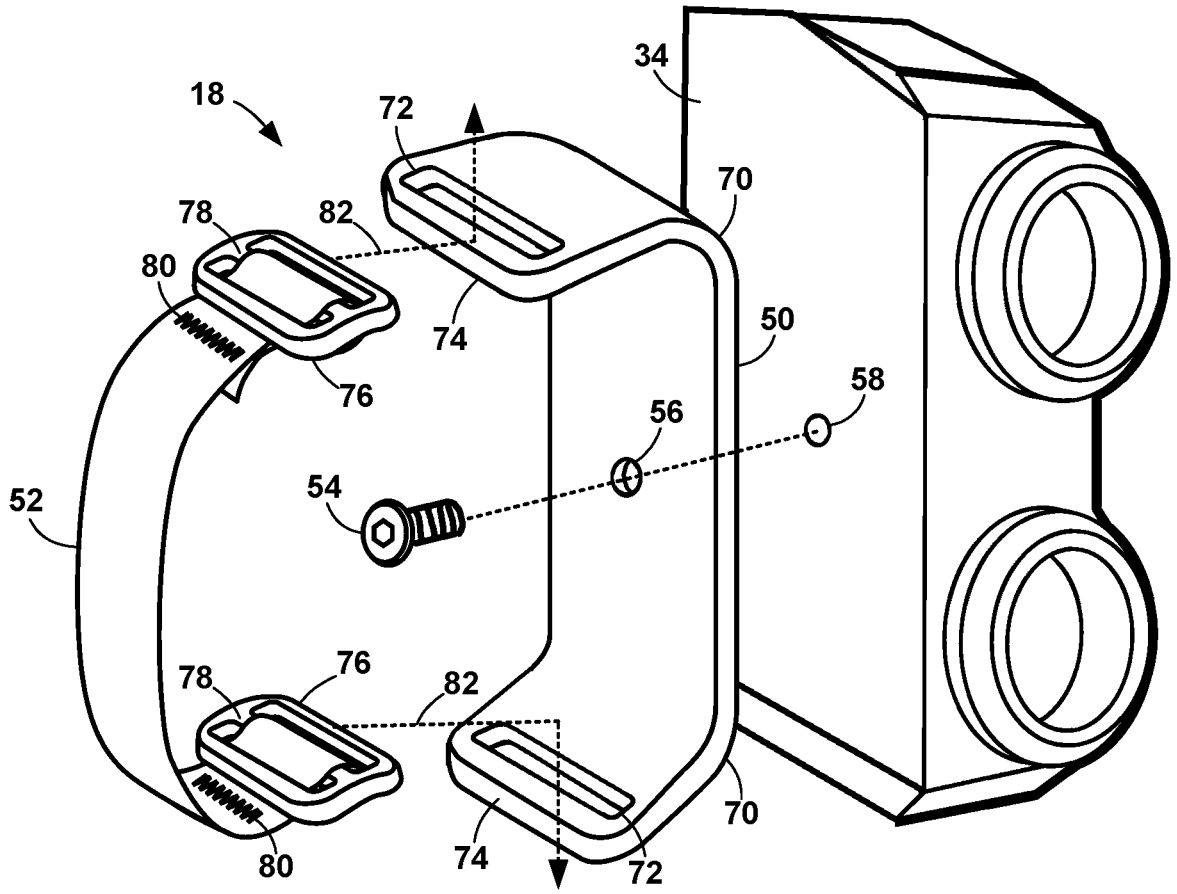
FIG. 13 is a perspective view of the light with one configuration of the removable strap prior to installation.
Figure 14:
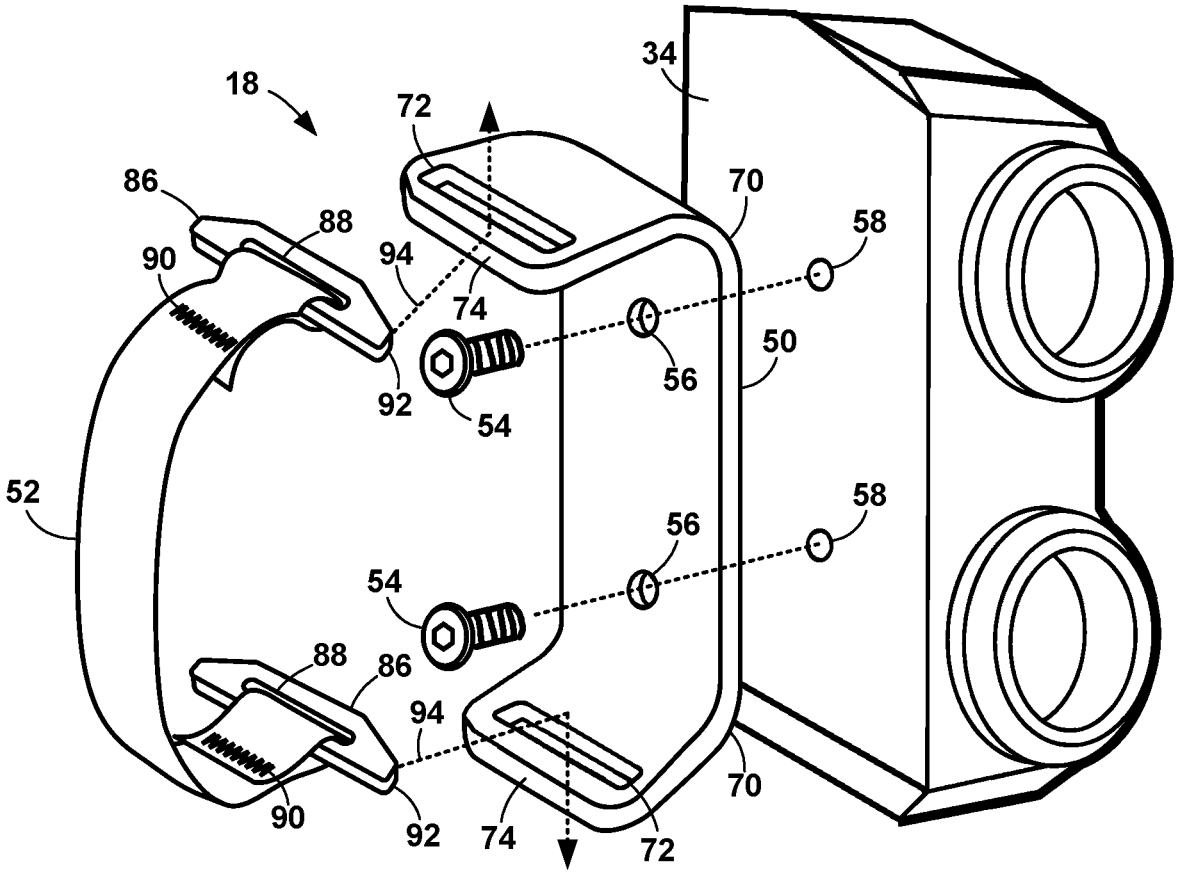
FIG. 14 is a perspective view of the light with another configuration of the removable strap prior to installation.

A removable attachment permits replacing the strap 52 with one of a different length. Two contemplated removable attachments are shown in FIGS. 13 and 14. In FIG. 13, the end of the strap 52 is looped around the center bar 78 of a ladder lock 76 and the overlapping sections are sewn together, as at 80. The ladder lock 76 is shorter than the strap slot 72 and the combination ladder lock 76 and strap 52 is thinner than the strap slot 72, and so slips through the strap slot 72, as at 82. When the strap 52 is pulled, as when wearing, the ladder lock 76 sits flat against the bracket 50, as in FIG. 11, thereby retaining the strap 52.

In FIG. 14, the end of the strap 52 is looped through a slot 84 of a toggle 82 and the overlapping sections are sewn together, as at 86. The toggle 82 is longer than the strap slot 72 and the combination toggle 82 and strap 52 is thinner than the strap slot 72. The toggle 82 slips through the strap slot 72 starting at its end 88. When the strap 52 is pulled, as when wearing, the edge 90 of the toggle 82 sits flat against the bracket 50, retaining the strap 52.

The light 10 can be mounted to a duty belt or vest by any practical means. The light 10 can be stored in a pouch or attached by a quick release mechanism, such as taught in U.S. Pat. No. 11,064,796.

When visibility dictates, the light 10 is removed from its storage and the non-shooting hand is slipped into the band 18. The light 10 is positioned so the inside 34 is adjacent to the back of the hand 2, as in FIG. 15. The light 10 frees the hand 2 to open a door, support the weapon, etc.

Thus, it has been shown and described a hand mounted light. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A hand-mounted light comprising:

(a) a housing having a front, a back, a top, a bottom, an inside, and an outside;

(b) a pair of lamps emitting light beams from the front, each lamp having a lens system for setting the divergence of the corresponding beam;

(c) a band attached to the inside and adapted to encircle a user's hand, the band including a bracket attached to the inside and a strap attached to the bracket;

(d) a power source for powering the lamps; and (e) a power control for controlling the luminosity of the lamps.

2. The light of claim 1 wherein one lamp has a wide beam, and the other lamp has a narrow beam.

3. The light of claim 1 wherein the divergence of each beam is adjustable.

4. The light of claim 1 wherein the power source includes replaceable batteries and wherein the housing has a hatch for installing and removing the batteries.

5. The light of claim 1 wherein the power source includes rechargeable batteries.

6. The light of claim 1 wherein the power control includes power switches that are duplicated on the top and the bottom.

7. The light of claim 1 wherein the power control includes a separate power switch for each lamp.

8. The light of claim 7 wherein each power switch provides an off position and at least two luminosity levels.

9. The light of claim 1 wherein the power control includes a luminosity level switch for each lamp and a master switch for applying power to both lamps.

10. The light of claim 1 wherein the housing is adjustable relative to the band in at least one of roll, pitch, and yaw.

11. The light of claim 1 wherein the housing is adjustable relative to the band in roll, pitch, and yaw.

12. The light of claim 11 wherein the bracket is attached to the housing via a ball joint that permits motion in roll, pitch, and yaw.

13. The light of claim 1 wherein the strap is elastic.

14. The light of claim 1 wherein the strap is removable.

15. A hand-mounted light comprising:

(a) a housing having a front, a back, a top, a bottom, an inside, and an outside;

(b) a wide beam lamp emitting a wide light beam from the front, a narrow beam lamp emitting a narrow light beam from the front;

(c) a band attached to the inside and adapted to encircle a user's hand, the band including a bracket attached to the inside and a strap removably attached to the bracket;

(d) replaceable batteries for powering the lamps, the housing having a hatch for installing and removing the batteries; and (e) a power control for controlling the luminosity of the lamps;

(f) the housing being adjustable relative to the band in at least one of roll, pitch, and yaw.

16. The light of claim 15 wherein divergence of the wide beam lamp and divergence of the narrow beam lamp are adjustable.

17. The light of claim 15 wherein the power control includes power switches that are duplicated on the top and the bottom.

18. The light of claim 15 wherein the power control includes a separate power switch, and each power switch provides an off position and at least two luminosity levels.

19. The light of claim 15 wherein the power control includes a luminosity level switch for each lamp and a master switch for applying power to both lamps.

20. The light of claim 15 wherein the housing is adjustable relative to the band in roll, pitch, and yaw.

21. The light of claim 20 wherein the bracket is attached to the housing via a ball joint that permits motion in roll, pitch, and yaw.

22. The light of claim 15 wherein the strap is elastic.

* * * * *